United States Patent [19]

Luber, deceased et al.

[11] 4,164,992

[45] Aug. 21, 1979

[54] DISPENSING UNIT

[75] Inventors: Lawrence B. Luber, deceased, late of Sikeston, Mo.; Beulah Luber, Intestate Successor, 706 Hunter St., Sikeston, Mo. 63801

[73] Assignee: Beulah F. Luber, Sikeston, Mo.

[21] Appl. No.: 851,811

[22] Filed: Nov. 16, 1977

[51] Int. Cl.[2] ..... E04H 3/04

[52] U.S. Cl. ..... 186/1 R; 280/DIG. 4; 312/236

[58] Field of Search ..... 186/1 R, 1 B, 1 D; 221/92; 312/42, 86, 236; 62/378, 382, 302, 457, 102; 280/DIG. 4, 33.99 F; 211/49 D

[56] References Cited

U.S. PATENT DOCUMENTS

| | | | |
|---|---|---|---|
| 474,357 | 5/1892 | Boldt | 62/378 |
| 2,432,749 | 12/1947 | Glassford | 62/378 |
| 2,679,143 | 5/1954 | Helsing | 62/102 |
| 3,113,816 | 12/1963 | Hulsey | 312/72 |
| 3,279,618 | 10/1966 | Bergstedt | 211/49 |
| 3,295,634 | 1/1967 | Buchbinder | 186/1 R |

*Primary Examiner*—Trygve M. Blix

*Assistant Examiner*—Reinhard J. Eisenzopf

*Attorney, Agent, or Firm*—Koenig, Senniger, Powers and Leavitt

[57] ABSTRACT

A unit for dispensing chilled cans and bottles of beverage on a first-in, first-out basis. The unit comprises a walk-in cooler having a ceiling, a floor, and front, rear and side walls, the front wall having an offset portion extending generally horizontally forwardly and then vertically downwardly for providing a counter at the front of the cooler outside the cooler and a recess below the counter inside the cooler. The counter has an opening therein closed by a door. The unit also includes a receptacle for holding a supply of chilled cans and bottles of beverage inside the cooler, the receptacle having an inlet through which cans and bottles are loaded into the receptacle, and an outlet through which cans and bottles are removed from the receptacle. The receptacle is in the recess below the counter opening with the outlet directly beneath the counter opening for removal of the cans and bottles from the receptacle and out of the cooler via the opening. The receptacle presents the cans and bottles for removal on a first-in, first-out basis.

10 Claims, 8 Drawing Figures

DISPENSING UNIT

BACKGROUND OF THE INVENTION

This invention relates to an improved unit for dispensing chilled cans and bottles of beverage (e.g., beer and soda). The unit is especially suited for use in taverns and the like and generally comprises a walk-in cooler that provides for self-dispensing of cans and bottles on a first-in, first-out basis.

Heretofore, it has been a common practice for many tavern owners to refrigerate their canned and bottled beverages in conventional coolers, such as refrigerators and ice-chests, located adjacent the bar for ready access by a bartender. However, use of such coolers presents certain problems, one being the frequent and time-consuming necessity of restocking the coolers in such a manner as to ensure that the unused cool stock is sold before the new warm stock. Thus, it is necessary to remove the unused supply of containers from a cooler before placing the new supply therein, and then to replace the old stock back in the cooler atop the new stock. Obviously, this procedure is tedious and time-consuming and reduces the time available for serving customers. This is particularly undesirable immediately prior to closing the tavern for the evening since this is usually the period of greatest demand by the customers for service, and the very time that restocking should be done. Thus, use of conventional coolers requires that the bartender spend this time restocking the coolers so that a sufficient supply of chilled beverage will be available for the next day's business.

Apparatus for dispensing chilled containers of beverage or the like is shown in U.S. Pat. Nos. 474,357, 2,679,143 and 3,113,816.

SUMMARY OF THE INVENTION

Among the several objects of this invention may be noted the provision of an improved unit comprising a walk-in cooler for dispensing chilled cans and bottles of beverage; the provison of such a unit which automatically dispenses cans and bottles on a first-in, first-out basis; the provision of such a unit which is quickly and easily restocked for such automatic dispensing; the provision of such a unit in which there is ready access to dispensed cans and bottles; the provision of such a unit which provides counter space in the bar area and which is pleasing in appearance; and the provision of such a unit which is economical to maintain and reliable in operation.

In general, a unit of this invention for dispensing chilled cans and bottles of beverage on a first-in, first-out basis comprises a walk-in cooler having a ceiling, a floor, and front, rear and side walls, the front wall having an offset portion extending generally horizontally forwardly and then vertically downwardly for providing a counter at the front of the cooler outside the cooler and a recess below the counter inside the cooler. The counter has an opening therein and a door for closing the opening. The unit also includes a receptacle for holding a supply of chilled cans and bottles of beverage inside the cooler. This receptacle has an inlet through which cans and bottles are loaded into the receptacle, and an outlet through which cans and bottles are removed from the receptacle. The receptacle is in the recess below the counter opening with the outlet directly beneath the counter opening for removal of the cans and bottles from the receptacle and out of the cooler via the opening. The receptacle presents the cans and bottles for removal therefrom on a first-in, first-out basis. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
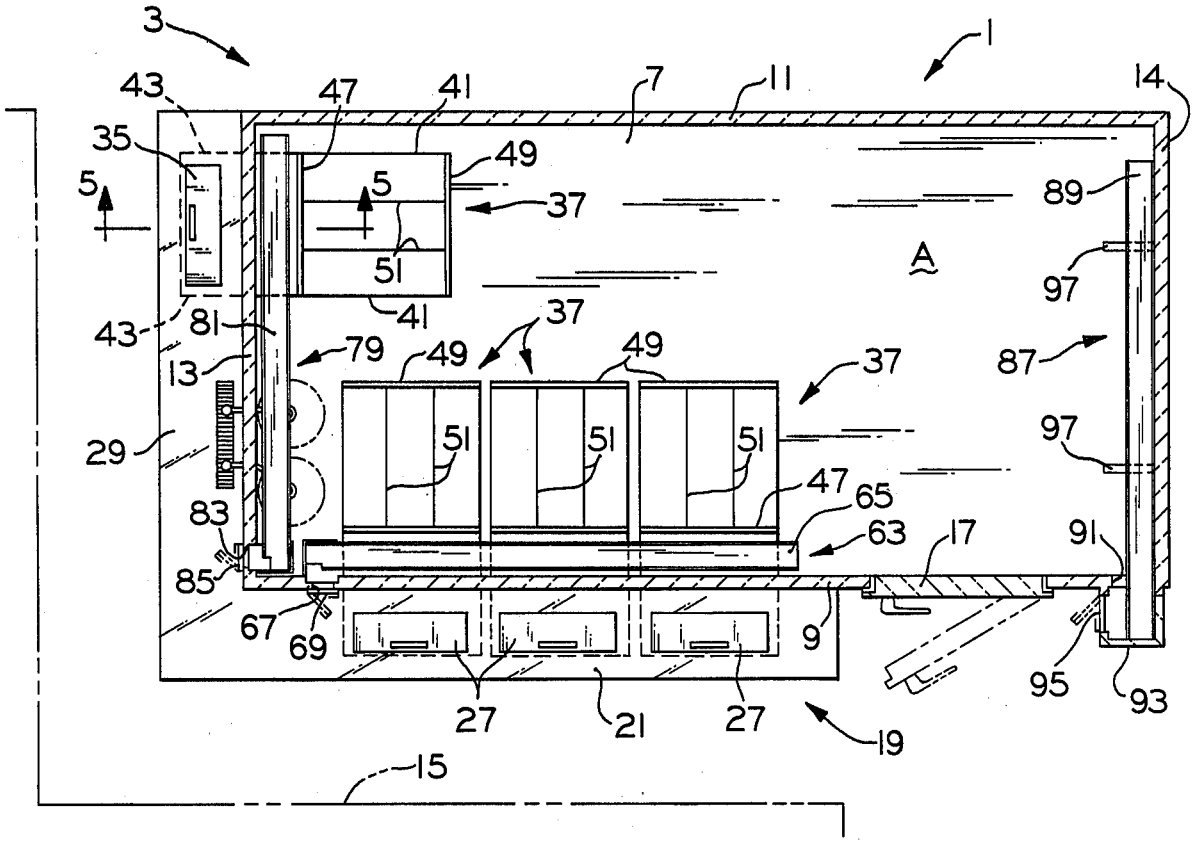
FIG. 1 is a plan of a unit of this invention for dispensing chilled cans and bottles of beverage, the unit being shown to comprise a walk-in cooler and a plurality of mobile dispenser carts for holding a supply of cans and bottles.

Referring to the drawings, particularly to FIG. 1, a unit of this invention for dispensing chilled cans and bottles of beverage (such as beer and soda) is indicated in its entirety by the reference numeral 1. This unit 1, which is particularly suited for use in taverns and other types of establishments where beverages are dispensed, is shown to comprise a walk-in cooler, generally designated 3, having a ceiling 5, floor 7, front wall 9, rear wall 11 and left and right side walls 13 and 14, respectively. A generally L-shaped bar 15 (the inside face of which is shown in phantom in FIG. 1) extends along the front and left side walls 9, 13 of the cooler and is suitably spaced therefrom for allowing a bartender to move freely between the bar and the cooler to service customers at the bar. A door 17 hinged to the front wall 9 of the cooler toward the right side 14 thereof provides access to the inside of the cooler.

As indicated generally at 19, the lower portion of the front wall 9 of the cooler to the left of door 17 is offset forwardly, the offset portion 19 extending horizontally forward and then vertically down to the cooler floor 7 for providing an elongate counter 21 at the front of the cooler outside the cooler and a recess 23 below counter 21 inside the cooler. This counter 21 has three openings 25 therein spaced along the counter and, each of the openings is closed by a door 27 hinged to the counter at the rear of the opening. Similarly, left side wall 13 of the cooler is offset outwardly (to the left as viewed in the drawings) for forming a counter 29 at that side of the cooler as well as a recess 31 inside the cooler beneath counter 29, the latter having an opening 33 therein toward its rear. This opening is closed by a door 35 identical to door 27.

Figure 5:
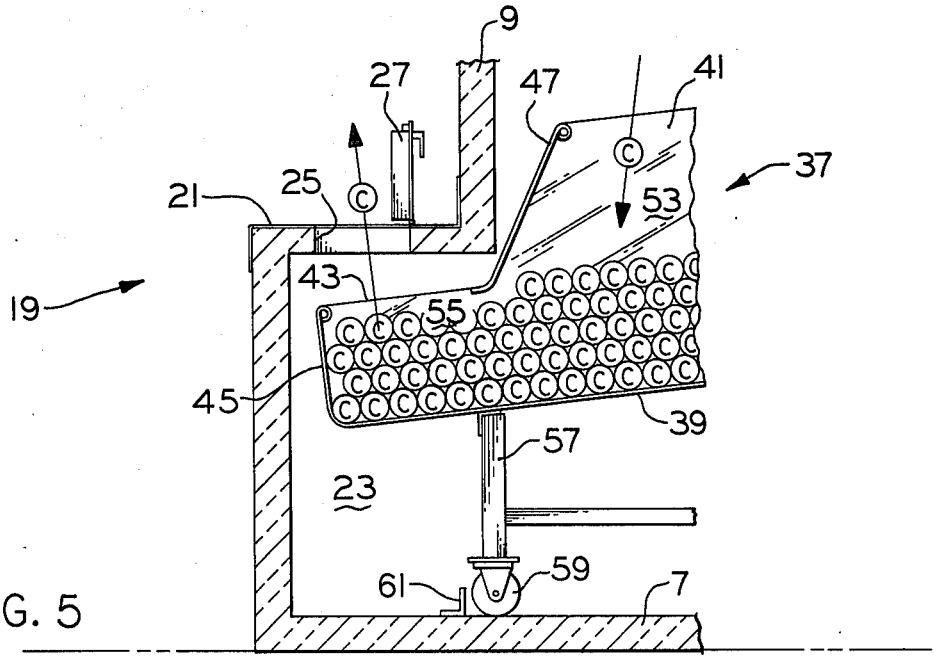
FIG. 5 is an enlarged section taken on line 5—5 of FIG. 1, illustrating details of the cooler and a mobile dispensing cart.

Four receptacles or carts, each generally designated 37, are positioned inside the cooler 3 below the counter openings 25,33 (see FIGS. 1 and 5) and constitute means for holding a supply of chilled beverage containers, such as cans C, for example, it being understood that the carts could also hold bottles. More particularly, each of these carts 37, which are fabricated from suitable sheet metal (such as galvanized or stainless steel), comprises a bottom 39, a pair of side walls 41, each having a lower extension 43 projecting forwardly (to the left) therefrom, and a front wall 45 extending between extensions 43. Side walls 41 are connected at their left ends by an inclined wall 47 sloping upwardly to the right from the rear of the extensions 43, and at their right ends by a rear wall 49 generally parallel to wall 47. Rear wall 49 and bottom 39 of the cart 37 preferably have holes (not shown) therein. To enable different brands of beverage to be kept separate in the cart, the latter is divided into three side-by-side compartments by a pair of partitions 51 extending from the back to the front of the cart.

Figure 2:
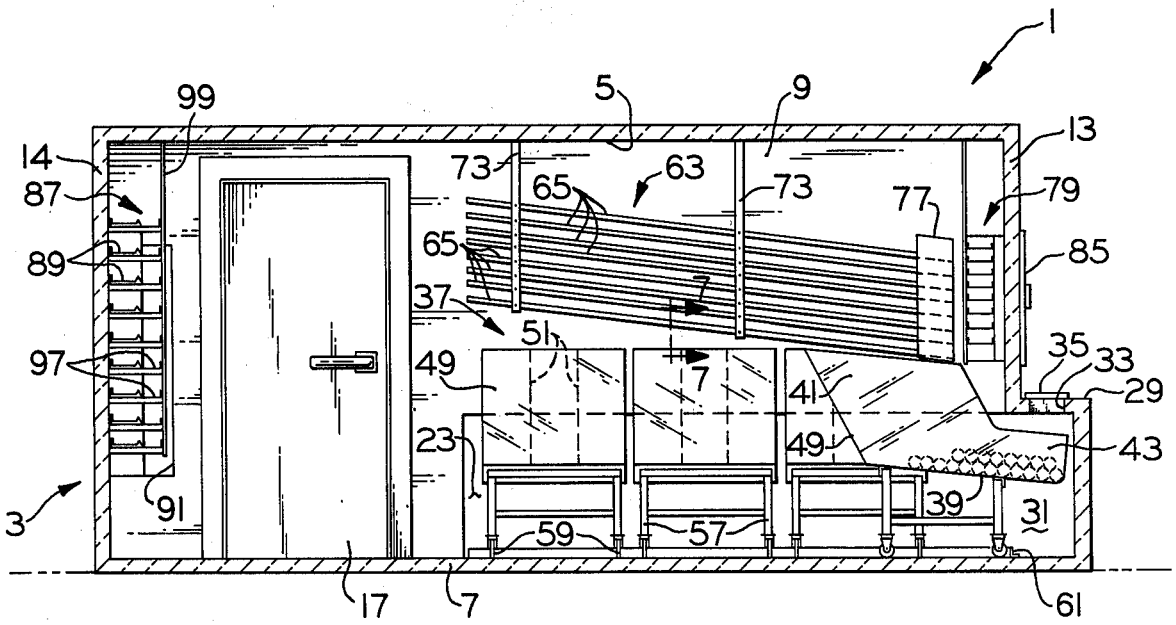
FIG. 2 is an elevational view of the interior of the front wall of the cooler shown in FIG. 1, showing a series of parallel inclined tracks on the front wall for holding and dispensing cans of beverage.

As shown, the top of each cart 37 is open between rear wall 49 and inclined wall 47 to provide an inlet 53 through which cans may be loaded into the cart. The top of the cart is also open between the front wall 45 and inclined wall 47 to provide an outlet 55 through which cans may be removed from the cart as desired. In this regard, carts 37 should be positioned in cooler 3 as shown in FIGS. 1 and 2, the front of the carts being in respective recesses 23,31 below the front and side wall counters 21,29, and outlets 55 directly beneath and immediately adjacent respective counter openings 25,33. Thus, upon receiving an order for a certain beverage, the bartender simply opens the appropriate counter door, reaches down through the opening and removes a can of that beverage from the cart below that opening. In this regard it will be observed that the bottom 39 of each of the receptacles is spaced a sufficient distance above the floor of the cooler and close enough to a respective counter opening for convenient removal of cans on the bottom of the receptacle.

In accordance with this invention, carts 37 automatically dispense cans C for removal from the carts through counter openings 25,33 on a first-in, first-out basis, thereby guaranteeing that old stock is used before new stock. Thus, the bottom 39 of each cart 37 is inclined downwardly from the back to the front of the cart for allowing the cans C toward the bottom 39 of the cart to roll toward the outlet 55. Inasmuch as the cans C toward the bottom are old stock (the freshly loaded stock generally being up above in the inlet 53), it will be apparent that as cans are removed from the cart, old stock will automatically precede new stock in advancing toward the outlet, thus ensuring that a first-in, first-out dispensing sequence is maintained.

Cart 37 is supported on a plurality (e.g., four) of legs 57 which extend down from the bottom 39 of the cart and have wheels 59 mounted thereon for allowing the cart to be rolled on cooler floor 7, this being desirable to facilitate loading of the cart. In this latter regard, supplies of canned and bottled beverage may be stocked in a floor storage area A in the right rear section of cooler 3. The mobility of the cart allows it readily to be moved from its dispensing station beneath a counter 21,29 to the storage area A for loading and then returned. An angle 61 extends along the cooler floor 7 beneath the counters for locating the cart beneath the counter opening.

Figure 8:
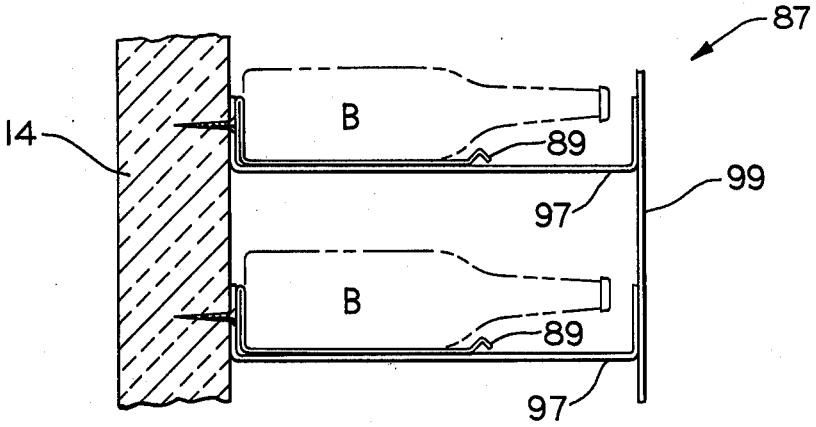
FIG. 8 is an enlarged section taken on line 8—8 of FIG. 4.

The dispensing unit 1 further includes a rack, generally indicated at 63, mounted on the inside of the front wall 9 of the cooler above three carts 37 (FIG. 2). This rack 63, which holds a supply of canned beverages, comprises a plurality (e.g., eight) of parallel tracks, each designated 65, stacked one above the other and inclined downwardly from left to right toward an elongate vertical opening 67 in the front wall of the cooler above the counter 21, this opening being closed by a dispenser door 69. Tracks 65 are generally U-shaped in cross section (see FIG. 8) for holding cans C on their sides and extending transversely with respect to the track, and are spaced from the cooler wall 9 by blocks 71 to which the tracks are secured by suitable fasteners. The sides of the tracks 65 away from the wall are supported by strap hangers extending down from the cooler ceiling 5 as indicated at 73.

Figure 6:
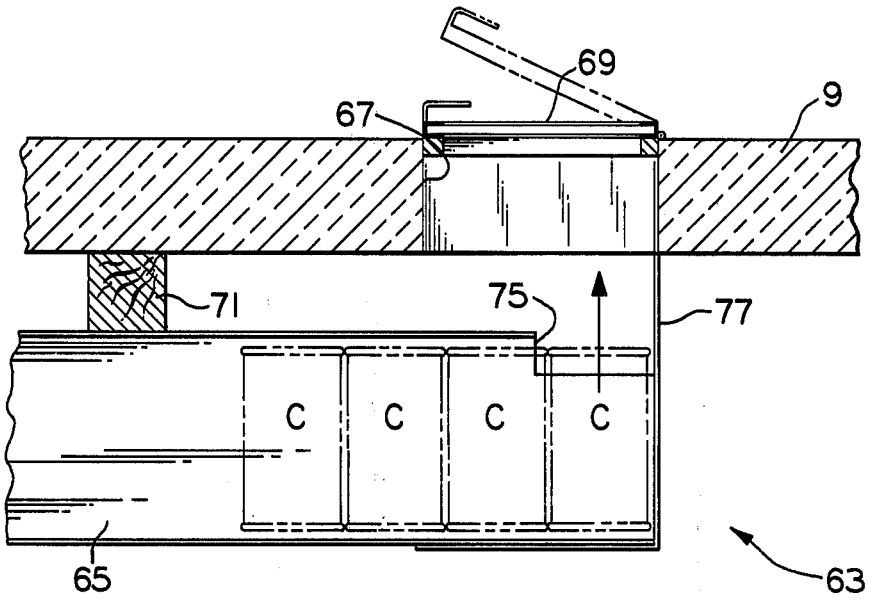
FIG. 6 is an enlarged fragment of FIG. 1 showing details of the lower end of one of the tracks on the front wall of the cooler.

As shown best in FIG. 6, the lower (right) end of each track 65 is immediately adjacent opening 67 in the cooler front wall 9 for allowing the can C at the end of the track to be removed from the cooler via the opening. A notch 75 in the lower end of the track allows the can readily to be grasped for facilitating such removal. To prevent the cans from rolling off the track, an elongate retainer 77, generally L-shaped in cross section, is secured at the right end of the tracks 65.

Figure 3:
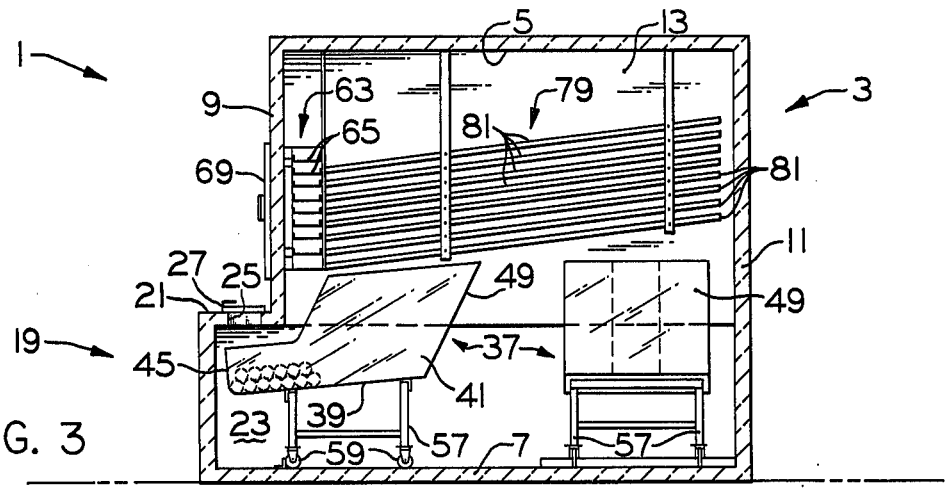
FIG. 3 is an elevational view of the interior of the left wall of the cooler shown in FIG. 1.
Figure 4:
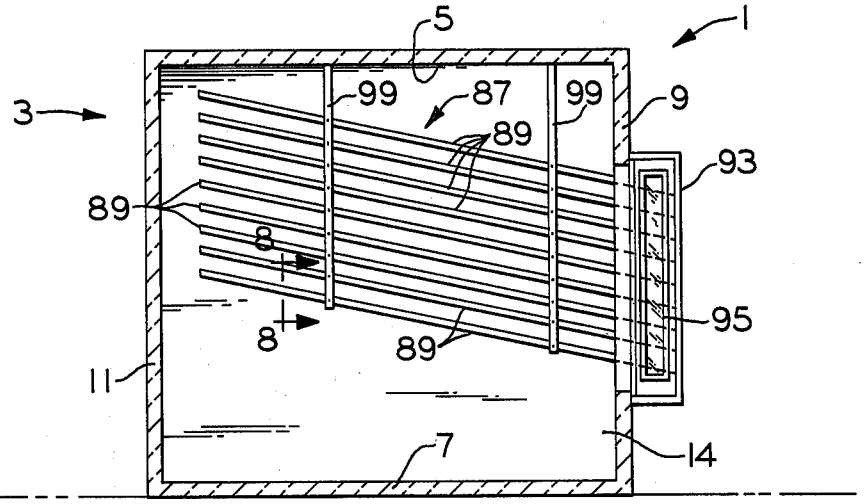
FIG. 4 is an elevational view of the interior of the right wall of the cooler shown in FIG. 1.

A second rack, generally designated 79 and substantially identical to rack 63, is shown in FIG. 3 mounted on the inside of the left side wall 13 of the cooler for holding an additional supply of canned beverage. The parallel tracks of this rack, each indicated at 81, angle downwardly from the rear to the front of cooler 3 toward an opening 83 in left side wall 13 above side counter 29, this opening being closed by a dispenser door 85.

Figure 7:
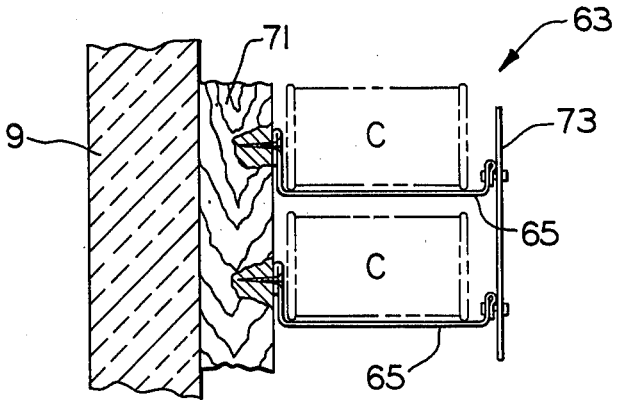
FIG. 7 is an enlarged section taken on line 7—7 of FIG. 2.

Mounted on the inside of the right side wall 14 of the cooler is a third rack, indicated generally at 87, for holding a supply of bottles B. This rack 87 also comprises a series of parallel tracks, each designated 89, inclined downwardly toward the front of the cooler. The lower ends of these tracks 89 extend through an opening 91 in the front wall 9 of the cooler and into a dispenser 93 outside the cooler at the front thereof, this dispenser having a door 95 for providing access to the bottles at the lower ends of tracks 89. FIG. 7 illustrates that bottle tracks 89 are shaped to hold the barrel portion of a bottle, the neck of the bottle being allowed to project beyond the right side of the track. Channel supports 97 are spaced at intervals along the length of the track for carrying the latter, and are secured directly to right wall 14 of the cooler by screws or other suitable fasteners. Strap hangers 99 extending down from the cooler ceiling 5 provide additional support for channel supports 97.

It will be understood that the three racks described above (can racks 63 and 79 and bottle rack 87), as well as the four mobile dispenser carts 37, provide automatic dispensing of beverage containers on a first-in, first-out basis, thus ensuring that old stock is used before new stock for minimizing spoilage. This dispensing sequence also allows warm new stock sufficient time to cool before being dispensed. Moreover, containers presented for removal from the racks and dispenser carts are readily accessible to the bartender in his usual location behind the bar. It will, of course, be noted that the number of carts 37 (and counter openings) may be varied to meet the needs of a particular establishment. Similarly, the location and number of racks, as well as the combination of rack types (either can or bottle), may also be varied according to need.

It will be observed from the foregoing that unit 1 is completely self-contained. Inasmuch as all beverage stock, dispensers, draught beer barrels, etc. are inside the cooler 3, much of the clutter heretofore seen in the bar area is eliminated, thus lending a more pleasing appearance to the bar. The unit also provides a substantial amount of valuable counter space for use by the bartender.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A unit for dispensing chilled cans and bottles of beverage on a first-in, first-out basis, said unit comprising a walk-in cooler having a ceiling, a floor, and front, rear and side walls, the front wall having an offset portion extending generally horizontally forwardly and then vertically downwardly for providing an elongate generally horizontal counter at the front of the cooler outside the cooler and a recess below the counter inside the cooler, said counter having a plurality of openings therein spaced along the counter and doors for closing the openings, and a plurality of mobile receptacles, one for each opening, for holding a supply of chilled cans and bottles of beverage inside the cooler, each of said receptacles having a bottom, an inlet through which cans and bottles are loaded into the receptacle, and an outlet through which cans and bottles are removed from the receptacle, said receptacles being adapted to be positioned side-by-side in said recess below the counter with the outlet of each of the receptacles directly beneath and immediately adjacent one of the counter openings for removal of the cans and bottles from the receptacle and out of the cooler via said opening, the bottom of each of the receptacles being spaced a sufficient distance above the floor of the cooler and close enough to a respective counter opening for convenient removal of cans and bottles on the bottom of the receptacle from the receptacle and out of the cooler via the opening, said receptacles presenting the cans and bottles for removal therefrom on a first-in, first-out basis.

2. A unit as set forth in claim 1 wherein said receptacle has an open top toward one end of the receptacle constituting its back end for providing said inlet and an open top toward the front end of the receptacle for providing said outlet, the bottom of the receptacle being inclined downwardly from the back to the front of the receptacle whereby on loading cans and bottles into the receptacle through the inlet, the cans and bottles roll along the bottom of the receptacle toward the outlet for removal.

3. A unit as set forth in claim 1 wherein said receptacle is a cart supported on a plurality of legs having wheels mounted thereon for allowing the receptacle to be rolled.

4. A unit as set forth in claim 1 wherein one of said cooler side walls has an offset portion substantially identical to that at the front of the cooler for providing a counter at that side of the cooler outside of the cooler and a recess below the counter inside the cooler, said side counter having an opening therein and a door for closing the opening, and another receptacle substantially identical to each of the aforesaid receptacles, said receptacle being adapted to be positioned with its outlet in the recess below the side counter for removal of cans and bottles from that receptacle and out of the cooler via the side counter opening.

5. A unit as set forth in claim 1 wherein said unit further comprises a rack on an inside wall of the cooler for holding a supply of cans and bottles of beverage, said rack comprising a plurality of parallel tracks stacked one above the other and inclined downwardly toward an elongate vertical opening in a wall of the cooler, said cans and bottles being adapted to lie on their sides in the tracks transversely with respect to the tracks for rolling along the tracks toward the cooler opening at the lower end of the tracks for removal of the cans and bottles from the cooler.

6. A unit as set forth in claim 5 wherein said cooler opening is in the wall on which said tracks are mounted and the lower ends of the tracks are adjacent the cooler opening for removal of the cans and bottles from the cooler through said opening.

7. A unit as set forth in claim 5 wherein said cooler opening is in a wall adjacent the wall on which said tracks are mounted and the lower ends of the tracks extend through said cooler opening for dispensing of the cans and bottles at the lower ends of the tracks.

8. A unit for dispensing chilled cans and bottles of beverage on a first-in, first-out basis, said unit comprising a walk-in cooler having a ceiling, a floor, and front, rear and side walls, the front wall having an offset portion extending generally horizontally forwardly and then vertically downwardly for providing a counter at the front of the cooler outside the cooler and a recess below the counter inside the cooler, said counter having an opening therein and a door for closing the opening, and a receptacle for holding a supply of chilled cans and bottles of beverage inside the cooler, said receptacle having an open top toward one end constituting its back end for providing an inlet through which cans and bottles are loaded into the receptacle and an open top toward its front end for providing an outlet through which cans and bottles are removed from the receptacle, the bottom of the receptacle being inclined downwardly from the back to the front of the receptacle whereby on loading cans and bottles into the receptacle through the inlet, the cans and bottles roll along the bottom of the receptacle toward the outlet for removal on a first-in, first-out basis, said receptacle further including a pair of side walls, each having a lower extension projecting forwardly therefrom, a wall extending between said extensions at the front thereof, a wall extending up from the extensions at the rear thereof and connecting said side walls at the front thereof, and a wall connecting the side walls at the rear thereof.

9. A unit as set forth in claim 8 wherein the wall extending up from said extensions slopes upwardly toward the rear of the receptacle.

10. A unit for dispensing chilled cans and bottles of beverage on a first-in, first-out basis, said unit comprising a walk-in cooler having a ceiling, a floor, and front, rear and side walls, the front wall having an offset portion extending generally horizontally forwardly and then vertically downwardly for providing a counter at the front of the cooler outside the cooler and a recess below the counter inside the cooler, said counter having an opening therein and a door for closing the opening, and a mobile receptacle for holding a supply of chilled cans and bottles of beverage inside the cooler, said receptacle having an inlet through which cans and bottles are loaded into the receptacle, and an outlet through which cans and bottles are removed from the receptacle, said receptacle being adapted to be positioned in said recess below the counter with said outlet directly beneath the counter opening for removal of the cans and bottles from the receptacle and out of the cooler via said opening, said receptacle presenting the cans and bottles for removal therefrom on a first-in, first-out basis, and said receptacle being divided into a series of side-by-side compartments each extending from the back to the front of the receptacle.

* * * * *